US005287560A

United States Patent [19]

Garcia

[11] Patent Number: 5,287,560

[45] Date of Patent: Feb. 22, 1994

[54] HAIR AND GARMENT PROTECTOR APPARATUS

[76] Inventor: Susan Garcia, 12435 W. Hidalgo, Avondale, Ariz. 85323

[21] Appl. No.: 877,747

[22] Filed: May 4, 1992

[51] Int. Cl.[5] ..... A42B 1/04; A42B 1/18

[52] U.S. Cl. ..... 2/202; 2/174; 2/206; 2/207; 2/410; 2/4; 132/274

[58] Field of Search ..... 2/202, 174, 204, 206, 2/207, 4, 5, 410; 150/154, 155, 156, 157, 158, 159, 160; 132/274

[56] References Cited

U.S. PATENT DOCUMENTS

| | | | |
|---|---|---|---|
| 2,294,593 | 9/1942 | Bailey | 2/4 |
| 2,447,561 | 8/1948 | Brenner | 2/174 |
| 3,145,393 | 8/1964 | Mufich | 2/202 |
| 3,505,678 | 4/1970 | Key | 2/4 |
| 3,983,580 | 10/1976 | Zeiber | 2/202 |
| 4,457,027 | 7/1984 | Gladstone | 2/174 |
| 4,665,567 | 5/1987 | Dilger | 2/174 |
| 4,698,853 | 10/1987 | Walton | 2/174 |
| 4,722,100 | 2/1988 | Greer | 2/174 |
| 4,887,316 | 12/1989 | Morandini | 2/202 |
| 5,091,993 | 3/1992 | Merrill et al. | 2/206 |

FOREIGN PATENT DOCUMENTS

| | | | |
|---|---|---|---|
| 3046259 | 6/1982 | Fed. Rep. of Germany | 2/202 |
| 1165524 | 10/1958 | France | 2/202 |
| 731635 | 6/1955 | United Kingdom | 2/202 |

*Primary Examiner*—Clifford D. Crowder
*Assistant Examiner*—Gloria Hale
*Attorney, Agent, or Firm*—H. Gordon Shields

[57] ABSTRACT

Hair and garment protector apparatus includes four panels appropriately secured together to define a generally cylindrical protector with a dome shaped top that sits on the top of a user's head and extends downwardly to about the upper portion of the user's chest and downwardly about to the level of the user's neck and upper back to protect garments being changed from makeup on the user. The protector apparatus is placed on the user's head after makeup is applied and prior to putting on clothing, and the apparatus is similarly used prior to removing the clothing to protect the clothing from makeup, and vice versa.

5 Claims, 1 Drawing Sheet

HAIR AND GARMENT PROTECTOR APPARATUS

BACKGROUND OF THE INVENTION

1. Field of Invention

This invention relates to protector apparatus and, more particularly, to protector apparatus for protecting a user's hairdo and garments from makeup while putting on and taking off the garment over the user's head.

2. Description of Prior Art

U.S. Pat. No. 2,294,593 (Bailey) discloses a head and face protector. The apparatus comprises a split system of a bonnet type. There are ties at the back of the apparatus that extend to the front and tie beneath the user's chin and over a relative short portion of the apparatus which extends down over the user's neck. The short portion extends over the user's neck only at the front of the apparatus.

U.S. Pat. No. 3,145,393 (Mufich) discloses a disposable head protector that is somewhat similar to the apparatus of the U.S. Pat. No. 3,145,393 patent. The apparatus includes a slit at the back, and ties from the back extending to the front for tying purposes.

U.S. Pat. No. 3,505,678 (Key) discloses a multi-purpose hair net apparatus in the generic configuration of a cylindrical hood. The apparatus includes ties that extend from the sides to the front. The apparatus is designed to protect the user's hairdo and it also may be used as a mosquito net.

U.S. Pat. No. 3,983,580 (Zeiber) discloses a multi-purpose hair net apparatus. The apparatus includes a dome which fits over the head and a skirt portion which extends downwardly from the dome. The apparatus includes ties adapted to be disposed about the torso of the user to hold the apparatus in place. The apparatus fits not only over the user's head, but apparently downwardly over the user's torso.

U.S. Pat. No. 4,665,567 (Dilger) discloses a protective mask which may be worn when dressing or changing clothes. The apparatus comprises a hood which is placed over the user's head. The hood apparatus includes three different embodiments, one of which is a hood made of transparent, air permeable material. A second embodiment is made from a generally rectangular piece of material folded along a central edge, and the sides of the material are appropriately secured together. The portion of the apparatus that fits over the lower portion of the user's face includes different types of elements to hold the material in place, such as "Velcro" type closures, or rubber, etc.

U.S. Pat. No. 4,698,853 (Walton) discloses a protective garment for a hairdo. The apparatus includes a garment which is secured together by a ring at the top of the user's head and which garment extends downwardly over the user's head, and onto the user's neck and shoulders. The elastic element is used to secure the garment about the user's neck.

U.S. Pat. No. 4,722,100 (Greer) discloses a hood made of a generally rectangular piece of material with rounded corners. The apparatus includes ties that extend from the rear of the apparatus to the front. The ties then tie beneath the users chin.

U.S. Pat. No. 4,887,316 (Morandini) discloses another type of head protector apparatus that is made of somewhat a cylindrical configuration with a generally flat top and rectangular element is secured to the flat top portion and extends downwardly in a cylindrical configuration. A zipper is used to close the vertically extending ends of the rectangular portion. There is an elastic band at the bottom or lower portion of the cylindrical portion for gathering the cylindrical portion about the user's neck.

It is noted, from the above discussed patents, that some type of tie or closure is usually present. however, such is not needed with the apparatus of the present invention. The apparatus of the present invention fits over a user's head and neck portion, both in the front and in the back, with the front extending lower than the back. The apparatus is made of four generally identical panels, appropriately sewn or stitched together to comprise a sleeve-like element that is easy to put on and easy to remove, and that protects both the user's hairdo and clothes from makeup, and vice versa. The apparatus is made of relatively light weight, non-clinging material.

SUMMARY OF THE INVENTION

The invention described and claimed herein comprises a protective covering to be put on the head of a user to protect the user's hairdo and clothing from makeup applied to the face. At the same time, the apparatus protects the user's makeup while clothes are being changed. The apparatus comprises four panels which are substantially identical and which are appropriately secured together to comprise a protective covering with relatively open sides that fit down over the user's shoulders but are closed generally above the shoulders to fully protect the user's hair. The apparatus is preferably made of non-cling material, which may be either a cloth or a tissue-type paper.

Among the objects of the present invention are the following:

To provide new and useful protective apparatus for a hairdo;

To provide new and useful protective apparatus fitting over a user's head;

To provide new and useful protective apparatus which includes four generally identical panels;

To provide new and useful protective apparatus in which a plurality of panels are appropriately secured together; and To provide new and useful protective apparatus for a user's head, neck, and upper torso while changing clothes.

DESCRIPTION OF THE PREFERRED EMBODIMENT

Figure 1:
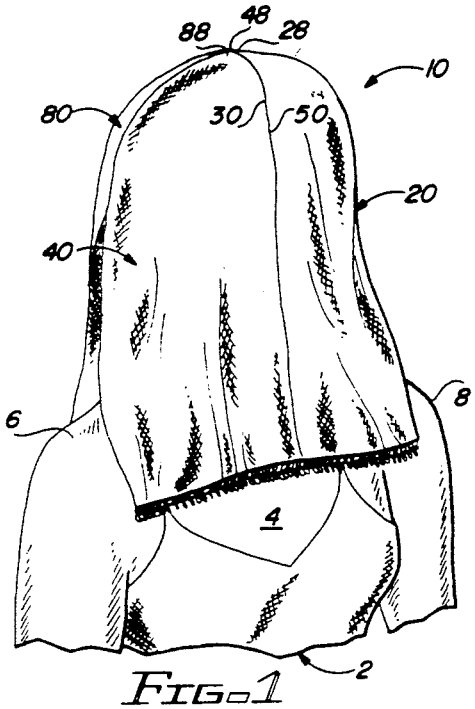
FIG. 1 comprises a perspective view of the apparatus of the present invention in its environment.

Protective head covering apparatus 10 of the present invention is shown in FIG. 1 in its use environment, namely disposed on the head of a user. The apparatus 10 extends downwardly over the neck and upper portion of the user's torso. A user 2 is shown, or the upper portion of a user 2 is shown. The portions of the user 2 which are shown include an upper chest area 4, a right shoulder and right arm 6, and a left shoulder and arm 8.

Figure 2:
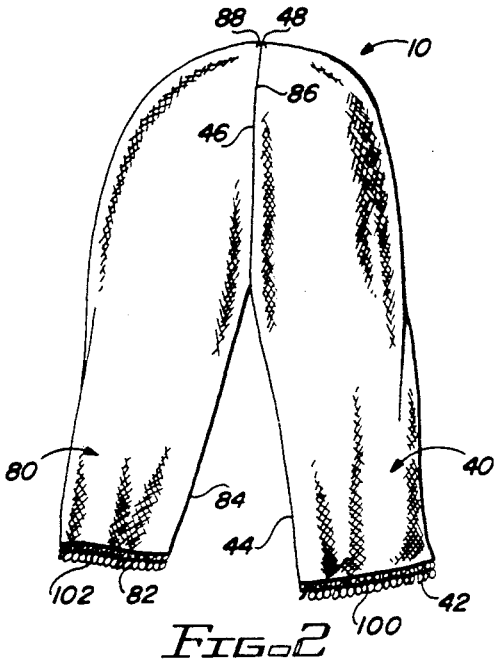
FIG. 2 is a side of the apparatus of the present invention.
Figure 3:
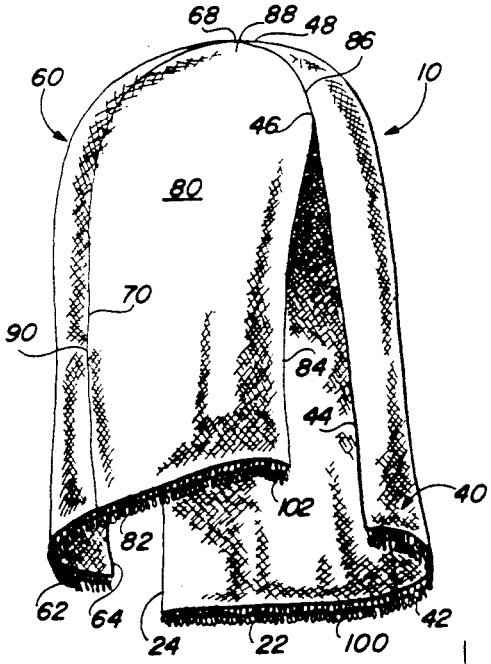
FIG. 3 is a lower rear perspective view of the apparatus of the present invention.
Figure 4:
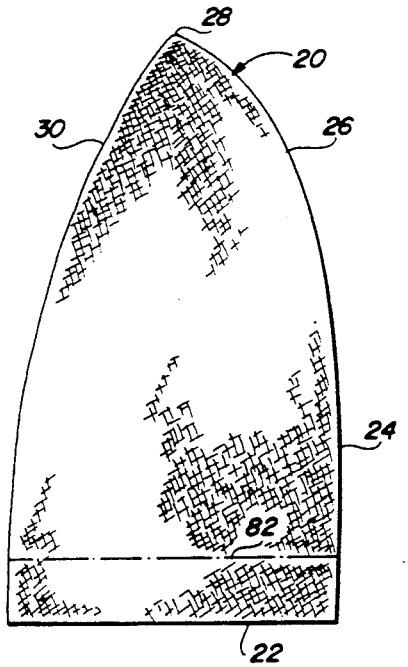
FIG. 4 is a plan view of a panel used in the fabrication of the apparatus of the present invention.

The apparatus 10 is shown in the side view in FIG. 2, and is shown in a bottom perspective view in FIG. 3. The apparatus 10 comprises four substantially identical panels, and one of those panels, panel 20, is shown in plan view in FIG. 4. For the following discussion of the apparatus 10, reference will be made to all four of the drawing figures.

The apparatus 10 includes four panels, a panel 20, a panel 40, a panel 60, and a panel 80. The panel 20 is shown in detail in FIG. 4. As indicated above, all four of the panels are substantially identical. Accordingly, only the panel 20 will be discussed in detail.

The panel 20 includes a bottom edge 22 which is generally straight. Extending upwardly from one end of the bottom edge 22 is an open edge 24. The open edge 24 is also relatively straight and is generally perpendicular to the bottom edge 22. From the upper portion of the open edge 24, remote from the bottom edge 22, there is an upper curved edge 26. The upper curved edge 26 extends to a top point or peak 28. From the top point or peak 28, there is a closed edge 30 which extends downwardly to the bottom edge 22. The closed edge 30 has a general curve to it.

The reason for the curves in both the edges 26 and 30 may be understood from FIGS. 1 and 3. The curved edges contribute to the overall cylindrical configuration of the apparatus 10 with a domed or curved top. The domed top, of course, is adapted to fit on and to be disposed on the top of the user's head.

Four separate panels 20, 40, 60, and 80 are shown clearly in FIG. 3. It will be noted, as best shown in FIG. 3, and as also may be understood from FIG. 1, that the long closed edges of the four panels are appropriately stitched together. The upper closed edges of the four panels are also appropriately stitched together.

The panel 40 includes a bottom edge 42, an open edge 44, and an upper closed edge 46 extending upwardly from the upper portion of the open edge 44 to a top point or peak 48. The panel 40 also includes a relative long closed edge 50. The closed edge 50 of the panel 40 is secured to, or stitched to, the long closed edge 30 of the panel 20. This is best shown in FIG. 1.

The panel 60 includes a bottom edge 62, an open edge 64, which extends upwardly from the bottom edge 62, and an upper closed edge, not shown. The upper closed edge of the panel 60 extends to a top 68, which is shown in FIG. 3. The panel 60 also includes a relatively long closed edge 70.

The panel 80, best shown in FIG. 3, includes a bottom edge 82, an open edge 84, an upper edge 86, and a relatively long closed edge 90. The upper closed edge 86 extends to a top 88. The long closed edge 70 of the panel 60 is appropriately secured, as by stitching, to the relatively long closed edge 90 of the panel 80.

As best shown in FIG. 2, the overall length of the panels 20 and 40, which comprise front panels, is slightly longer than the overall length of the panels 60 and 80. The panels 60 and 80 comprise the rear panels of the apparatus 10.

The upper closed edges of adjacent panels are also secured together, as by stitching. In FIG. 2, the upper closed edges 46 and 86 of the panels 40 and 80 are stitched together. The other upper closed edges 30 and 50 of the panels 20 and 60 are similarly secured together.

The open edges 24 and 26 of the panels 20 and 60, and the open edges 44 and 84 of the panels 40 and 80, face each other. The adjacent open edges, as best shown in FIG. 1, comprise openings which allow the panels to open to receive the shoulders of the user. In this manner, the bottom edges extend downwardly to cover the neck of the user and also the upper chest portion to provide added protection for clothing for any makeup used on the throat or neck area, etc., of the user. The adjacent open edges define openings or slots which receive the shoulders of the user. A decorative fringe 100 is appropriately secured to the bottom edges 22 and 42 of the front panels 20 and 40 and a similar decorative fringe 102 is secured to the bottom edges 62 and 82 of the panels 60 and 80. The fringes 100 and 102 are purely for decorative purposes, or aesthetic purposes, since they serve no functional purpose. The open edges 24, 44, 64, and 84 are appropriately seamed, etc., to prevent unravelling, etc. Decorative fringe may also be used on the open edges, as or if desired.

While the overall length of the front panels 20 and 40 is slightly longer than the overall length of the rear panels 60 and 80, the length of the upper closed edges of all four panels is substantially the same so that the panels will appropriately fit together to comprise a relatively cylindrical, domed, top protective element 10, with the side openings which receive the shoulders of the user.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What is claimed is:

1. Hair and garment protector apparatus for protecting a user's head, comprising, in combination:

a dome portion disposed on the top of a user's head;

front panel means extending downwardly from the dome portion for covering the user's face and neck to protect makeup on the face while the user puts on and takes off clothing;

back panel means extending downwardly from the dome portion for covering the back of the user's head and neck, with the front panel means extending downwardly slightly longer than the back panel means; and open slots between the front and back panel means for receiving the user's shoulders.

2. The apparatus of claim 1 in which the front panel means comprises a first front panel and a second front panel, the first and second front panels having substantially identical configurations and secured to each other.

3. The apparatus of claim 2 in which the back panel means comprises a first back panel and a second back panel, the first and second back panels having substantially identical configurations and secured together.

4. The apparatus of claim 3 in which the first front panel is also secured to the first back panel, and the second front panel is also secured to the second back panel.

5. The apparatus of claim 4 in which the open slots are disposed between the first front and back panels and between the second front and back panels.

* * * * *